United States Patent [19]

Paans

[11] 3,990,364

[45] Nov. 9, 1976

[54] MULTICOLOR OFFSET SCREEN PRINTING METHOD

[76] Inventor: Herbert Paans, Reuthbergsiedlung 22, 8672 Selb, Germany

[22] Filed: Aug. 21, 1975

[21] Appl. No.: 606,668

Related U.S. Application Data

[63] Continuation of Ser. No. 468,450, May 9, 1974, abandoned.

[30] Foreign Application Priority Data

May 15, 1973 Germany ..... 2324516

[52] U.S. Cl. ..... 101/129; 101/43; 101/115; 101/126

[51] Int. Cl.[2] ..... B41F 15/10

[58] Field of Search ..... 101/114, 115, 123, 124, 101/129, 41–44

[56] References Cited

UNITED STATES PATENTS

| | | | |
|---|---|---|---|
| 2,484,671 | 10/1949 | Bauman | 101/114 X |
| 2,904,916 | 9/1959 | Stahmann | 101/114 X |
| 3,688,695 | 9/1972 | James | 101/44 X |
| 3,735,699 | 5/1973 | Koelschbach | 101/115 X |
| 3,868,902 | 3/1975 | Bradshaw et al. | 101/44 |

FOREIGN PATENTS OR APPLICATIONS

| | | | |
|---|---|---|---|
| 763,572 | 12/1956 | United Kingdom | 101/41 |

*Primary Examiner*—Edgar S. Burr
*Assistant Examiner*—R. E. Suter

[57] ABSTRACT

The invention provides for a screen printing method for printing on ceramic articles, wherein color in the form of an image to be printed is transferred via intermediate carriers on to the article to be imprinted wherein the improvement resides in that four intermediate carriers are each provided simultaneously with a color extract to produce a four-color print from a plurality of circulating intermediate carriers, and these color extracts are then transferred to four of a plurality of circulating articles, the cycle of the articles being staggered in relation to that of the intermediate carriers so that each intermediate carrier with a different color extract is brought up to each article in succession. The invention has particular application to a four-color print.

3 Claims, 1 Drawing Figure

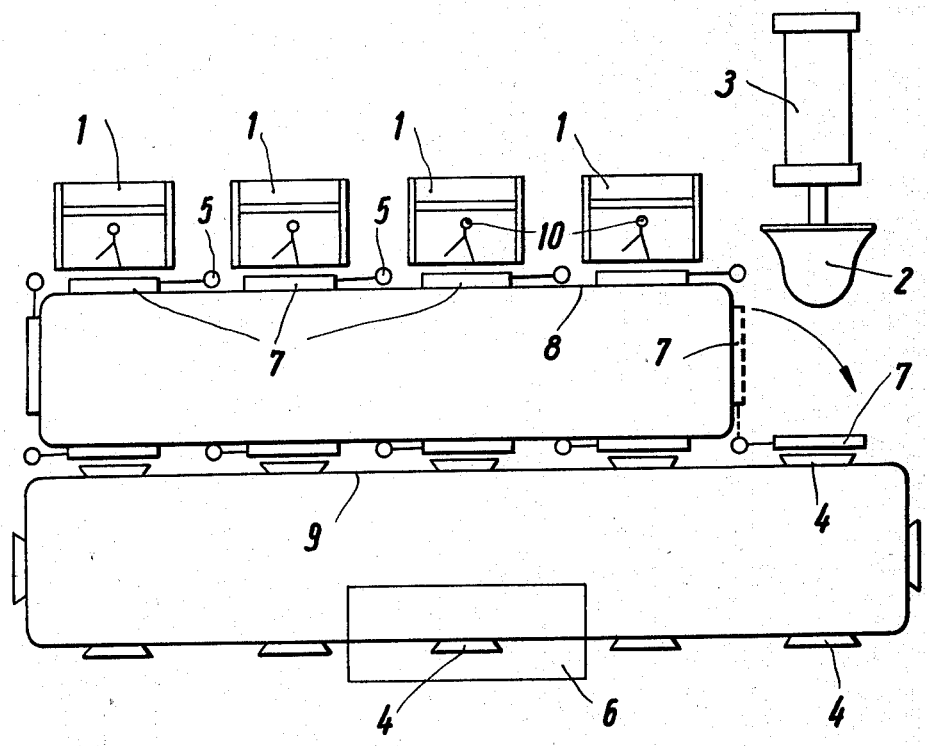
1
1
1
1
3
5
5
10
2
7
8
7
7
9
4
4
6
4

MULTICOLOR OFFSET SCREEN PRINTING METHOD

This application is a continuation of U.S. application Ser. No. 468,450 filed May 9, 1974, and now abandoned.

The invention relates to a screen printing method for printing on ceramic articles, wherein a colour in the form of an image to be printed is transferred via intermediate carriers to the article to be imprinted, and to an apparatus for carrying out this method.

The use of the screen printing method for printing on ceramic articles, such as plates, dishes and bowls, is already known (from German Offenlegungsschrift Nos. 1 761 823 and 1 771 781). In this case a colouring matter in powder form is applied to a screen comprising a multitude of small holes which are adapted to the grain size of the colouring matter and arranged in the form of the image to be transferred. In one stage of the operation an intermediate carrier, usually in the form of a flexible diaphragm and provided with a special coating for retaining the pigment, is located below the screen, the pigment which is pressed through the screen by means of a doctor being applied to the said intermediate carrier. The intermediate carrier is then pivoted through 180° over the article and pressed against the latter by means of a block or stamp or a pressure pad attached to the end thereof, thereby transferring the pigment to this article. The pigment is then firmly applied to the article in a drying kiln.

Only a single colour can be printed with the known apparatus.

Accordingly, the problem underlying the invention is to provide a method and apparatus of the type described at the beginning of the specification whereby a multicoloured image (a coloured picture) can be printed on ceramic articles.

This problem is solved by the method according to the invention in that for a four-colour print from a plurality of circulating intermediate carriers, four intermediate carriers are each provided simultaneously with a colour extract and these colour extracts are then transferred to four of a plurality of circulating articles, the cycle of the articles being staggered in relation to that of the intermediate carriers so that each intermediate carrier with a different colour extract is brought up to each article in succession.

The invention has particular application to a four-colour print. However, a different number of colours can also be used, which naturally results in a correspondingly different number of intermediate carriers or articles.

The four intermediate carriers each provided with a separate colour are normally each guided in succession up to an article so that the colour extracts are transferred successively from the four intermediate carriers to the four articles.

The staggering of the cycle can be achieved in two different ways. On the one hand, staggering can be achieved by controlling the cycle of the articles or intermediate carriers. For example, by momentarily stopping the articles while the intermediate carriers continue to circulate or by momentarily stopping the intermediate carriers while the articles continue to circulate. Alternatively staggering can be achieved by selecting the number of articles in one cycle so that they are not even multiples in relation to the number of intermediate carriers in a cycle, without necessitating any interference in the cycle control.

The apparatus for putting the method according to the invention into practice comprises a conveyor belt on which lie the intermediate carriers and above which four screen units for the four different colours are arranged in such a manner that each intermediate carrier can be accurately guided thereunder, and a conveyor belt for carrying the articles which is arranged opposite the intermediate carrier conveyor and controlled in such a manner that with each conveying stage an intermediate carrier can be turned on to an article which is guided into a position for colour absorption.

According to the method of the invention the intermediate carrier conveyor belt is stopped, by the apparatus for carrying out this method, first in a position in which four intermediate carriers lie below the four screen units. A colour extract is then applied via each screen unit to the associated intermediate carrier. Then in four separate conveying stages the intermediate carriers are guided successively each up to an article and swung on to the latter. The colour extract of the intermediate carrier is then transferred on to its associated article by means of a pressure pad which forces the intermediate carrier on to this article. In the next conveying stage the next article is guided into the colour-receiving position and the next intermediate carrier with a different colour in turn brought up to this article, etc. After the four articles have each received a different colour, they pass through a drying kiln where the colour extract firmly adheres to the articles. Then the articles are again guided successively into the colour-receiving position. As this movement takes place, intermediate carriers have simultaneously been provided with colour extracts. However, these carriers are then guided by a staggered conveying movement up to the articles so that the latter then receive the next colour. This cycle is repeated four times in all so that all the articles receive the four different colours in succession. Then the articles are subjected to further conventional treatment (glazing or the like).

In an advantageous embodiment of the apparatus according to the invention the conveyor belt for the intermediate carriers circulates in a vertical plane; in this connection the intermediate carriers in a vertical section of this plane can be swung into the horizontal position on to the likewise horizontal articles. The article conveyor also circulates preferably in a vertical plane, in which case each article can be guided during a conveying stage into the colour-receiving position on the top side of this plane.

The invention will be described in more detail below with the aid of a diagram illustrating a practical embodiment.

In the embodiment illustrated in the drawing four screen units 1, each provided with a doctor 10, are horizontally arranged in juxtaposition for applying four different colours of a multi-colour image. Below these screen units a conveyor belt 8 for conveying intermediate carriers circulates in a vertical plane. Intermediate carriers 7 are arranged on this conveyor belt 8, but they can be pivoted about a joint 5 through an angle of 90°. The intermediate carriers 7 are equidistant from one another, as are the screen units 1, and can be guided with precision under the screens. Below the conveyor belt 8 an article conveyor 9 is also arranged in a vertical plane. The articles 4 — plates — are equidistantly arranged on this conveyor belt 9. On one side the article conveyor 9 extends beyond the conveyor belt 8 for intermediate carriers so that (on the right hand side in the drawing) a colour-receiving position is provided for the articles wherein they are not covered by the intermediate carrier conveyor belt — i.e. they lie in the open — and can be detained in this position. The conveyor belt 8 can be stopped for each intermediate carrier 7 in colour transfer positions in which the intermediate carriers 7 lie with their pivots 5 in the lower corner of the plane of the conveyor for intermediate carriers (on the right-hand side, at the bottom, of the drawing). As illustrated by the arrow in the drawing, the intermediate carriers 7 can be swung downwardly through 90° over the article 4 which is in the colour-receiving position. After this pivoting movement, a pressure pad 2 driven by a driving mechanism 3 presses the intermediate carrier 7 on to the article 4 in order to transfer the colour from the carrier 7 to this article. The article conveyor 9 moves through a drying kiln 6 in which the colour extract is caused to adhere firmly to the articles 4.

I claim:

1. A screen-printing method for printing onto ceramic articles wherein different color extracts from a plurality of screen units are transferred from intermediate carriers in the form of an image to be printed onto the ceramic articles to be imprinted, comprising the steps of simultaneously applying different color extracts from a plurality of said screen units to a plurality of said intermediate carriers, moving one of said intermediate carriers and one of said ceramic articles to a printing station, applying color extract from said one intermediate carrier to said one ceramic article when said one intermediate carrier and said one ceramic article are at said printing station, moving said one ceramic article and said one intermediate carrier away from said printing station and returning said one ceramic article to said printing station again, moving a different one of said intermediate carriers to said printing station, and applying color extract from said different one of said intermediate carriers to said one ceramic article at said printing station.

2. A method in accordance with claim 1 further including the step of pressing said intermediate carriers into engagement with successive ceramic articles at said printing station to apply a different color extract to each of said ceramic articles.

3. A method in accordance with claim 1 further including the step of drying said ceramic articles after each of the different color extracts is applied to said ceramic articles.

* * * * *